US006761538B2

(12) United States Patent
Fitts et al.

(10) Patent No.: US 6,761,538 B2
(45) Date of Patent: Jul. 13, 2004

(54) CONTINUAL RADIAL LOADING DEVICE FOR STEAM TURBINE REACTION TYPE BUCKETS AND RELATED METHOD

(75) Inventors: David Orus Fitts, Ballston Spa, NY (US); Ronald Wayne Korzun, Clifton Park, NY (US); John Thomas Murphy, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 14 days.

(21) Appl. No.: 10/284,390

(22) Filed: Oct. 31, 2002

(65) Prior Publication Data

US 2004/0086387 A1 May 6, 2004

(51) Int. Cl.[7] ..... F01D 5/32
(52) U.S. Cl. ..... 416/221; 416/204
(58) Field of Search ..... 416/218, 221, 416/204 A

(56) References Cited

U.S. PATENT DOCUMENTS

| | | | | |
|---|---|---|---|---|
| 3,070,351 A | * | 12/1962 | Hunt | 416/221 |
| 3,326,523 A | * | 6/1967 | Melvin | 415/209.3 |
| 3,936,227 A | | 2/1976 | Wojcik | |
| 4,022,545 A | * | 5/1977 | Shank | 416/221 |
| 5,713,721 A | | 2/1998 | Glynn et al. | |
| 6,398,500 B2 | | 6/2002 | Pedersen et al. | |

* cited by examiner

*Primary Examiner*—Ninh H. Nguyen
(74) *Attorney, Agent, or Firm*—Nixon & Vanderhye P.C.

(57) ABSTRACT

A loading spring segment for radially loading a turbine bucket within a turbine rotor groove includes a substantially circular metal sheet with a gap between opposed edges of the sheet, the sheet defining an arcuate segment in an arcuate length direction of the spring segment; and a plurality of radial slots in the sheet, spaced along the arcuate length direction to thereby create a plurality of individual springs within the arcuate segment.

16 Claims, 2 Drawing Sheets

CONTINUAL RADIAL LOADING DEVICE FOR STEAM TURBINE REACTION TYPE BUCKETS AND RELATED METHOD

BACKGROUND OF THE INVENTION

This invention relates to steam turbine bucket technology and, more specifically, to a radial loading spring used in the installation of steam turbine reaction type buckets in steam turbine rotor grooving.

Current practice for radial loading of steam turbine reaction style buckets involves inserting each bucket into a retaining groove in the steam turbine rotor, inserting a loading pin in a tightly controlled radial gap between the bottom of the bucket and the rotor groove, and then hammering the pin such that the pin plasticly deforms in the rotor radial direction and loads the bucket radially against a hook in the retaining groove. For each bucket, there is a loading pin and each loading pin must be hammered manually until the bucket does not move in the rotor groove. This hammering operation, however, introduces an opportunity to damage the bucket as well as the rotor. Accordingly, there is a need for an improved radial loading technique that provides parts reduction, rotor assembly time reduction, and consistent radial loading of the buckets against the rotor groove hook without danger of damage to the buckets and/or rotor.

BRIEF DESCRIPTION OF THE INVENTION

This invention replaces the loading pin technique with radial loading spring segments that eliminate the hammering operation and reduce the number of discrete parts required for bucket installation. In the exemplary embodiment, the new radial loading spring segment may have a "C" cross-section, but the final spring cross-section could vary in order to achieve the desired loading force on the buckets. The span or arcuate length of the spring segments could be as much as 360°, which would mean that only one spring segment per annular spring groove would be required. More than one spring groove (for example, a pair of side-by-side annular grooves) could be utilized in order to achieve a higher loading force on the bucket, and more than one spring segment may be utilized to fill the one or more 360° spring grooves in each turbine stage. One advantage of utilizing shorter spring segments is ease of installation of the spring segment in the groove, and ease of installation of the buckets in the groove.

In the preferred arrangement, numerous radial slices (also referred to as slots) are made in each spring segment, thus effectively forming multiple individual springs in each segment, so that the compression of the spring under one particular bucket is localized under that bucket, and not affect the spring loading on adjacent buckets. The radial slices can be made perpendicular to the segment centerline, or at the same angle as the bucket dovetail rhombus angle.

Accordingly, in one aspect, the invention relates to a loading spring segment for radially loading a turbine bucket within a turbine rotor groove, the loading spring comprising a substantially circular metal sheet with a gap between opposed edges of the sheet, the sheet defining an arcuate segment in a length direction of the spring segment; and a plurality of radial slots in the sheet, spaced along the length direction to thereby create a plurality of individual springs in the arcuate segment.

In another aspect, the invention relates to a turbine rotor and bucket assembly comprising a rotor formed with a bucket retaining groove about a periphery thereof; a plurality of buckets, each having a mounting portion including a radially inner face received within the bucket retaining groove; an annular spring groove located in a base portion of the bucket retaining groove, and at least one radial loading spring segment seated in the annular spring groove, radially interposed between the base portion of the bucket retaining groove and the radially inner face portion of at least one of the plurality of buckets; the radial loading spring element comprising a metal sheet of substantially circular cross-section, with a gap between opposed edges thereof, and at least one radial slot in the circular sheet to thereby form at least two discrete springs within the spring segment.

In still another aspect, the invention relates to a method of assembling a turbine bucket to a rotor wherein the turbine bucket is formed with a male dovetail and the rotor is formed with a peripheral female dovetail groove, wherein the female dovetail groove has a base portion formed with an annular spring retaining groove, the method comprising a) locating a radial loading spring segment of predetermined arcuate length in the spring retaining groove; b) twisting the bucket to enable the male dovetail to pass into the female dovetail; c) applying a radial force to the bucket to thereby compress the radial loading spring segment; and d) twisting the turbine bucket to a desired orientation where the male dovetail is fully seated within the female dovetail.

DETAILED DESCRIPTION OF THE INVENTION

Figure 1:
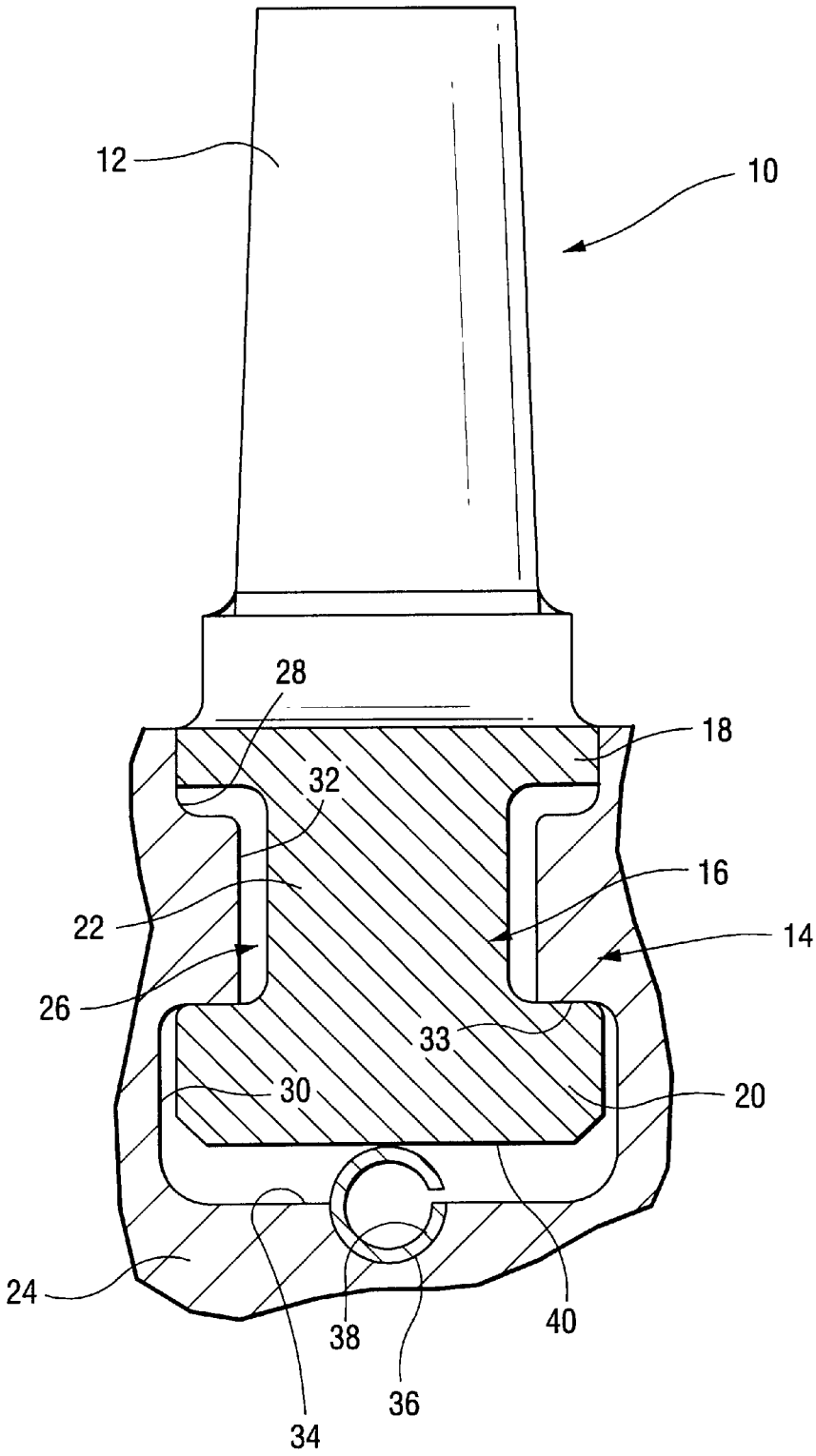
FIG. 1 is a partial cross-section illustrating a turbine bucket installed on a rotor with a radial spring segment located radially between the bucket and rotor in accordance with an exemplary embodiment of the invention.

With reference to FIG. 1, a turbine bucket 10 includes an airfoil portion 12 and a root or base portion 14 that is configured as a male dovetail 16. The male dovetail includes radially outer and inner projections or hooks 18, 20 radially spaced by a narrow neck 22.

The rotor 24 is formed with an annular bucket retaining groove configured as a female dovetail slot 26 about the periphery of the wheel with a radially outer wide groove portion 28 for receiving the outer male projection 18, a radially inner wide groove portion 30 for receiving the inner male projection 20, and an intermediate narrow groove portion 32 for receiving the narrow neck 22. An undersurface 33 of the narrow groove portion 32 forms a so-called "hook" that is engaged by the inner projection 20 on the male dovetail 16. Within the base 34 of the female dovetail slot, there is formed an annular spring retaining groove 36 that extends completely about the periphery of the wheel. The groove itself extends substantially 180° when viewed in cross-section (as in FIG. 1). A loading spring segment 38 is shown within the groove 36, radially interposed between the base 34 of the dovetail slot and the radially inner face 40 of the bucket dovetail. As indicated above, more than one groove 36 may be used, depending on the required radial loading on the buckets. The spring segment 38 biases the bucket in a radially outward direction, loading the bucket radially against the hook 33.

Figure 2:
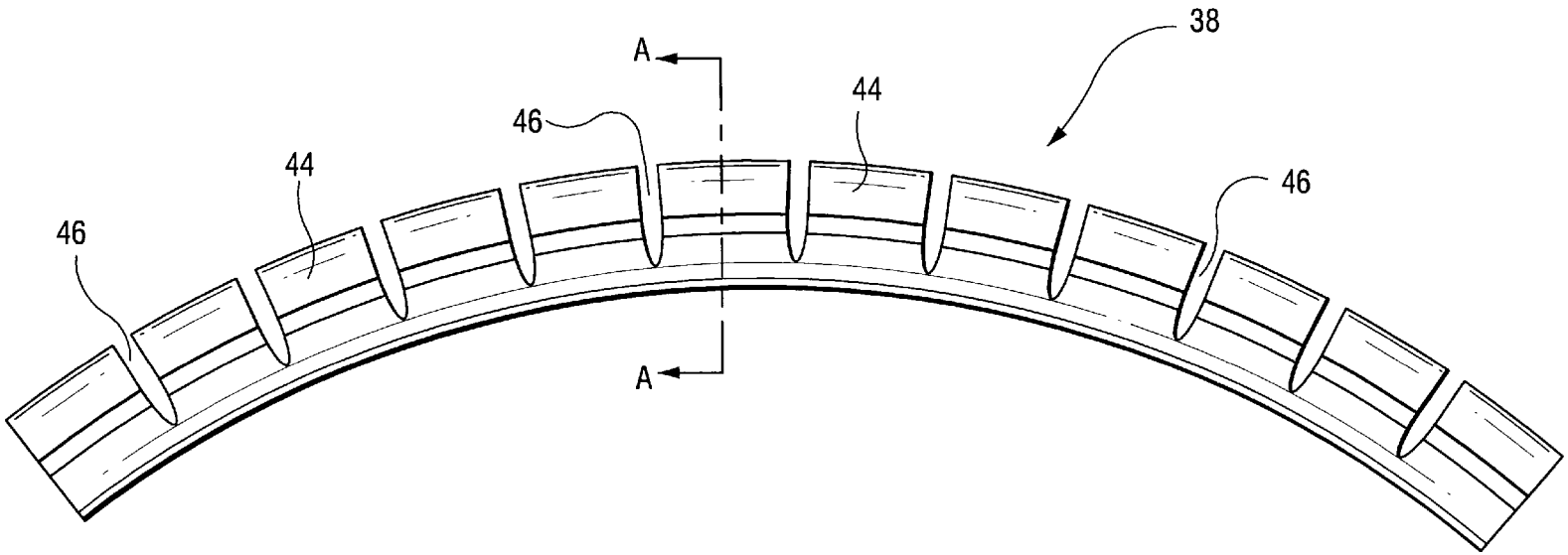
FIG. 2 is a side elevation of a radial spring segment in accordance with the invention.
Figure 3:
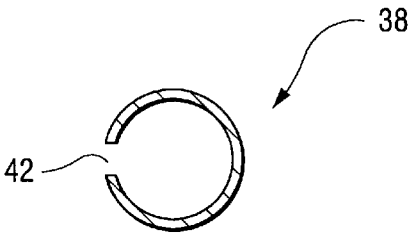
FIG. 3 is a section view along the line 3—3 of FIG. 2.

Turning to FIGS. 2 and 3, the loading spring segment 38 is made of a spring steel sheet (e.g., X-750), rolled to a circular shape (in cross-section), with a gap 42 between opposed edges of the sheet. This gap allows the spring to be compressed as described further herein, and must be large enough that the opposed edges of the spring do not contact each other when the bucket is loaded into the groove.

As shown in FIG. 2, the spring segment 38 has an arcuate length of about 80°, but the arcuate length may vary from very short (preferably at least the arcuate length of a single bucket) to substantially 360°.

Individual springs 44 are effectively formed in the spring segment 38 by providing a plurality of deep, radial slices or slots 46 spaced along the arcuate length of the segment. In other words, the radial slots 46 create multiple individual springs 44 within the single spring segment 38. As apparent from FIG. 2, the radial slots 46 extend more than 180° about the segment 38, the exact depth of the slots being variable to achieve desired spring properties.

The arcuate length of each spring 44 within the segment 38 is such that each bucket mounted on the rotor 24 has its own spring. Thus, if one segment were to support, for example, six adjacent buckets, the segment length and individual spring lengths would be chosen accordingly to provide one spring 44 per bucket. Shorter segments facilitate installation of both the segment 36 and the bucket 10, while longer segments 36 further reduce the number of parts required. Whatever segment length is chosen, the spring segment configuration as described provides localized compression under each bucket, with no effect on the radial spring loading on adjacent buckets.

The installation methodology is as follows. The one or more loading spring segments 38 are placed in the spring groove 36 in the rotor 24. Note that the gap 42 is preferably located 90° from a location where the spring segment engages the radially inner face 40 of the bucket, as seen in FIG. 1. The bucket 10 is installed by first locating it in its approximate circumferential location on the rotor. The bucket 10 is then twisted such that the bucket male dovetail 16 fits into the minimum width of the rotor groove, i.e., the narrow groove portion 32. The bucket is then pushed radially towards the rotor centerline, compressing a loading spring 44 until the male dovetail hook 20 is radially inboard of the rotor hook 33. The bucket 10 is then twisted back to its proper orientation as shown in FIG. 1, for operation and moved circumferentially to its final position.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A loading spring segment for radially loading turbine buckets within a turbine rotor groove, the loading spring segment comprising a substantially circular metal sheet with a gap between opposed edges of the sheet, said sheet defining an arcuate segment in an arcuate length direction of the spring segment; and a plurality of radial slots in said sheet, spaced along said arcuate length direction to thereby create a plurality of individual springs within said arcuate segment adapted to provide localized compression to the turbine buckets.

2. The loading spring segment of claim 1 wherein said sheet comprises stainless steel.

3. The loading spring segment of claim 1 wherein said arcuate segment extends along a plurality of buckets in said arcuate length direction.

4. The loading spring segment of claim 1 wherein said plurality of radial slots each extend more than 180° about the sheet.

5. A turbine rotor and bucket assembly comprising a rotor formed with a bucket retaining groove about a periphery thereof; a plurality of buckets, each having a mounting portion including a radially inner face received within said bucket retaining groove; an annular spring groove located in a base portion of said bucket retaining groove, and at least one radial loading spring segment seated in said annular spring groove, radially interposed between said base portion of said bucket retaining groove and the radially inner face of at least one of said plurality of buckets; said radial loading spring segment comprising a metal sheet of substantially circular cross-section, with a gap between opposed edges thereof, and at least one radial slot in said circular sheet to thereby form at least two discrete springs within said radial loading spring segment.

6. The assembly of claim 5 wherein said sheet comprises stainless steel.

7. The assembly of claim 5 wherein said radial loading spring segment extends along a plurality of buckets in said arcuate length direction.

8. The loading spring segment of claim 5 wherein said at least one radial slot extends more than 180° about the sheet.

9. The assembly of claim 5 wherein said mounting portion comprises a male dovetail and said bucket retaining groove comprises a complementary female dovetail.

10. The assembly of claim 5 wherein said gap is located substantially 90° from a location where said radial loading spring segment engages said radially inner face portion.

11. A method of assembling a turbine bucket to a rotor wherein the turbine bucket is formed with a male dovetail and said rotor is formed with a peripheral female dovetail groove, wherein the female dovetail groove has a base portion formed with an annular spring retaining groove, the method comprising:

a) locating a radial loading spring segment of predetermined arcuate length in said spring retaining groove;

b) twisting the bucket to enable the male dovetail to pass into the female dovetail groove;

c) applying a radial force to the bucket to thereby compress the radial loading spring segment; and d) twisting the turbine bucket to a desired orientation where the male dovetail is fully seated within the female dovetail groove.

12. The method of claim 11 wherein the radial loading spring segment comprises a substantially circular metal sheet with a gap between opposed edges of the sheet, said sheet defining an arcuate segment in an arcuate length direction of the spring segment; and a plurality of radial slots in said sheet, spaced along said arcuate length direction to thereby create a plurality of individual springs within said arcuate segment.

13. The method of claim 11 wherein said sheet comprises stainless steel.

14. The method of claim 11 wherein said arcuate segment extends along a plurality of buckets in said arcuate length direction.

15. The method of claim 11 wherein said plurality of radial slots each extend more than 180° about the sheet.

16. The method of claim 11 wherein, during step a), said gap is located substantially 90° from a location where said spring segment engages said radially inner face portion.

* * * * *